US012529306B2

(12) United States Patent
Sugiura et al.

(10) Patent No.: US 12,529,306 B2
(45) **Date of Patent: *Jan. 20, 2026**

(54) INTEGRATED CENTERLINE DATA RECORDER

(71) Applicant: SANVEAN TECHNOLOGIES LLC, Katy, TX (US)

(72) Inventors: Junichi Sugiura, Bristol (GB); Stephen Jones, Cypress, TX (US); Chad Feddema, Conroe, TX (US)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 575 days.

This patent is subject to a terminal disclaimer.

(21) Appl. No.: 17/967,692

(22) Filed: Oct. 17, 2022

(65) Prior Publication Data

US 2023/0030409 A1 Feb. 2, 2023

Related U.S. Application Data

(63) Continuation of application No. 16/929,960, filed on Jul. 15, 2020, now Pat. No. 11,512,587.

(60) Provisional application No. 62/875,748, filed on Jul. 18, 2019.

(51) Int. Cl.

| | |
|---|---|
| ***E21B 47/26*** | (2012.01) |
| ***E21B 41/00*** | (2006.01) |
| ***E21B 47/13*** | (2012.01) |
| ***E21B 49/00*** | (2006.01) |

(52) U.S. Cl.

CPC ..... *E21B 47/26* (2020.05); *E21B 41/00* (2013.01); *E21B 47/13* (2020.05); *E21B 49/003* (2013.01)

(58) Field of Classification Search

None

See application file for complete search history.

(56) References Cited

U.S. PATENT DOCUMENTS

| | | | | |
|---|---|---|---|---|
| 7,735,579 | B2 * | 6/2010 | Gopalan | E21B 47/24 175/48 |
| 2006/0070443 | A1 * | 4/2006 | Pristup | G01P 15/0888 73/514.08 |
| 2009/0194332 | A1 * | 8/2009 | Pastusek | E21B 47/017 702/9 |
| 2010/0247335 | A1 * | 9/2010 | Atherton | F04D 15/00 702/141 |
| 2013/0248247 | A1 * | 9/2013 | Sugiura | E21B 47/12 702/9 |
| 2014/0329657 | A1 * | 11/2014 | Miller | B04B 13/00 494/37 |

(Continued)

*Primary Examiner* — Lina Cordero

(74) *Attorney, Agent, or Firm* — Ewing & Jones, PLLC

(57) ABSTRACT

A system includes a sensor carrier and an integrated data recorder. The sensor carrier includes an outer sub body and an inner sub body. The inner sub body is coupled to the outer sub body by a support leg. The inner sub body includes a recess formed therein. The sensor carrier includes a flow path defined as the space between the outer sub body, the inner sub body, and the support leg. The integrated data recorder is positioned within the recess of the inner sub body such that the integrated data recorder is substantially at the centerline of the sensor carrier. The integrated data recorder includes a sensor package including one or more drilling dynamics sensors, a processor, a memory module, and an electrical energy source.

20 Claims, 13 Drawing Sheets

(56) References Cited

U.S. PATENT DOCUMENTS

| | | | | |
|---|---|---|---|---|
| 2018/0045850 | A1* | 2/2018 | Smidth | G01V 20/00 |
| 2018/0066513 | A1* | 3/2018 | Sugiura | E21B 47/01 |
| 2018/0128098 | A1* | 5/2018 | Jones | E21B 4/003 |
| 2018/0371889 | A1* | 12/2018 | Hohl | E21B 44/00 |
| 2019/0284881 | A1* | 9/2019 | Hohl | E21B 17/073 |
| 2019/0360320 | A1* | 11/2019 | Hohl | E21B 21/08 |

* cited by examiner

INTEGRATED CENTERLINE DATA RECORDER

This application is a continuation of and claims priority to U.S. nonprovisional application Ser. No. 16/929,960, filed Jul. 15, 2020, that itself claims priority from U.S. provisional application No. 62/875,748, filed Jul. 18, 2019, each of which is hereby incorporated by reference in its entirety.

TECHNICAL FIELD/FIELD OF THE DISCLOSURE

The present disclosure relates generally to oilfield equipment, and specifically to integrated data recorders for oilfield equipment.

BACKGROUND OF THE DISCLOSURE

Wellbores are traditionally formed by rotating a drill bit positioned at the end of a bottom hole assembly (BHA). The drill bit may be actuated by rotating the drill pipe, by use of a mud motor, or a combination thereof. As used herein, the BHA includes the drill bit. Conventionally, BHAs may contain only a limited number of sensors and have limited data processing capability. The operating life of the drill bit, mud motor, bearing assembly, and other elements of the BHA may depend upon operational parameters of these elements, and the downhole conditions, including, but not limited to rock type, pressure, temperature, differential pressure across the mud motor, rotational speed, torque, vibration, drilling fluid flow rate, force on the drill bit or the weight-on-bit ("WOB"), inclination, total gravity field, gravity toolface, revolutions per minute (RPM), radial acceleration, tangential acceleration, relative rotation speed and the condition of the radial and axial bearings. The combination of the operational parameters of the BHA and downhole conditions are referred to herein as "drilling dynamics."

To supplement conventional BHA sensors, drilling dynamics data may be measured by drilling dynamics sensors. Measurement of these aspects of elements of the BHA may provide operators with information regarding performance and may indicate need for maintenance.

SUMMARY

The present disclosure provides for a system. The system may include a sensor carrier. The sensor carrier may include an outer sub body and an inner sub body. The inner sub body may be coupled to the outer sub body by a support leg. The inner sub body may have a recess formed therein. The sensor carrier may include a flow path defined as the space between the outer sub body, the inner sub body, and the support leg. The system may include an integrated data recorder positioned within the recess of the inner sub body such that the integrated data recorder is substantially at the centerline of the sensor carrier. The integrated data recorder may include a sensor package including one or more drilling dynamics sensors, a processor in data communication with the one or more drilling dynamics sensors, a memory module in data communication with the one or more drilling dynamics sensors, and an electrical energy source in electrical communication with the memory module, the one or more drilling dynamics sensors, and the processor.

The present disclosure also provides for a system. The system may include a downhole tool having a bore. The system may include a sensor carrier coupled to the downhole tool and positioned within the bore of the downhole tool.

The sensor carrier may include an outer sub body and an inner sub body. The inner sub body may be coupled to the outer sub body by a support leg. The inner sub body may have a recess formed therein. The sensor carrier may include a flow path defined as the space between the outer sub body, the inner sub body, and the support leg. The system may include an integrated data recorder positioned within the recess of the inner sub body such that the integrated data recorder is substantially at the centerline of the sensor carrier. The integrated data recorder may include a sensor package including one or more drilling dynamics sensors, a processor in data communication with the one or more drilling dynamics sensors, a memory module in data communication with the one or more drilling dynamics sensors, and an electrical energy source in electrical communication with the memory module, the one or more drilling dynamics sensors, and the processor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
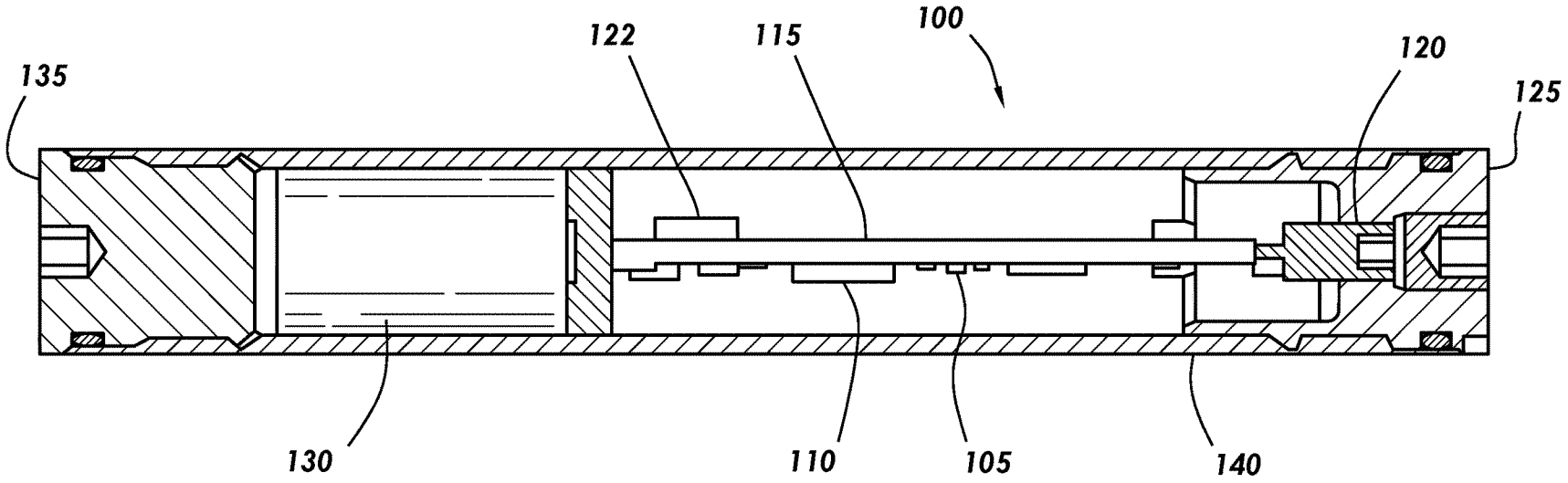
FIG. 1 depicts a cross section of an integrated data recorder consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an embodiment of integrated data recorder 100 consistent with at least one embodiment of the present disclosure. The embodiment of integrated data recorder shown in FIG. 1 is a "pressure barrel" design. Integrated data recorder 100 includes sensor package 110. Sensor package 110 may include drilling dynamics sensors including, but not limited to, low-g accelerometers for determination of inclination, total gravity field, radial acceleration, tangential acceleration, and/or low-g vibration sensing; and/or gravity toolface; high-g accelerometers for shock sensing; temperature sensors; three-axis gyroscopes for rotation speed (angular velocity) computation; three-axis magnetometers for rotation speed (angular velocity) and toolface (angular position) computation; Hall-effect sensors to measure relative rotation speed, along with a magnetic marker or markers; one or more strain gauges to measure one or more of tension, compression, torque on bit, weight on bit, bending moment, bending toolface, and pressure. Sensor package 110 may include any or all of drilling dynamics sensors listed and may include other drilling dynamics sensors not listed. Sensor package 110 may include redundant sensors, for example and without limitation, two 3-axis low-g accelerometers and/or two 3-axis gyro sensors. Redundant sensors may improve reliability and accuracy. Further, the drilling dynamics sensors may be used for determination of other drilling dynamics data other than that listed. In certain embodiments, one or more of the drilling dynamics sensors may be digital, solid-state sensors. Digital, solid-state sensors may create less noise, have a smaller footprint, have lower mass, be more shock-resistant, be more reliable and have better power management than analog sensors. In some embodiments, one or more of the drilling dynamics sensors may be analog sensors. In some such embodiments, analog sensors may be used, for example and without limitation, with analog-to-digital converters. In certain embodiments, the accelerometers may be three-axis accelerometers. The three-axis accelerometers may be digital or analog sensors, including, but not limited to quartz accelerometers. In some embodiments, the gyroscopes may be three-axis gyroscopes.

As used herein, low-g accelerometers may measure up to between +/−16 G. As used herein, high-g accelerometers may measure up to between +/−200 G. Rotation speed in RPM (revolutions per minute) may be measured, for example, between 0 and 500 RPM. Temperature may be measured, for example, between −40° C. and 175° C., between −40° C. and 150° C. or between −40° C. and 125° C. As further described herein below, the measurement range of the sensors may be programmable while integrated data recorder 100 is within the wellbore. For example, the low-g accelerometers measurement range may be changed from +/−4 G to +/−16 G while drilling. For example, the high-g accelerometers measurement range may be changed from +/−100 G to +/−400 G while drilling.

With further attention to FIG. 1, integrated data recorder 100 may include memory module 115 in data communication with sensor package 110. Memory module 115 is adapted to store data gathered by the sensors in sensor package 110. Memory module 115 is in data communication with communication port 120. Communication port 120 is adapted to provide a data communications link between memory module 115 and a surface processor. Communication port 120 may be adapted to communicate with other processors in a communication bus (e.g. MWD tool) via a common communication bus, for example, transmitting drilling dynamics data, statistics based on drilling dynamics data, rock mechanics information, or a combination thereof to surface via MWD.

Also depicted in FIG. 1 is processor 105. Processor 105 may be in data communication with the sensors in sensor package 110 and memory module 115. Processor 105 may control the operation of the sensors in sensor package 110, as described herein below. Processor 105 may include application software/firmware stored on a computer readable media, such as program flash memory, which is part of processor 105. One non-limiting example of processor 105 with program flash memory is a 16-bit microcontroller, Model SM470R1B1M-HT from Texas Instruments (Dallas, Texas, USA). The application software/firmware may include instructions, for example and without limitation, for executing deep-sleep mode, standby mode, and active mode, as described herein below. The application software/firmware in processor 105 may be loaded and replaced, via communication port bus 176 through communication port 120, by a surface processor. Integrated data recorder 100 may further include a real-time clock, an oscillator, a fuse, and a voltage regulator. Processor 105 includes, but is not limited to a microcontroller, microprocessor, DSP (digital signal processor), DSP controller, DSP processor, FPGA (Field-Programmable Gate Array), GPU (Graphics Processing Unit) or combinations thereof.

Memory module 115, processor 105, and sensor package 110 and/or the sensors in sensor package 110 may be in electrical communication with electrical energy source 130. Electrical energy source 130 provides power to processor 105, memory module 115, and the sensors in sensor package 110. In some non-limiting embodiments, electrical energy source 130 may be a lithium battery. In yet other embodiments, electrical energy source 130 may be electrically connected to sensors in sensor package 110 indirectly through a voltage regulator. In other embodiments, electrical energy source 130 may be positioned in a package separate from sensor package 110. In certain embodiments, electrical energy source 130 is a battery, such as a rechargeable battery or a non-rechargeable battery. In other embodiments, electrical energy source 130 may be a rechargeable or non-rechargeable battery with an energy harvesting device. In some embodiments, the energy harvesting device may be a piezo-electric energy harvester or a MEMS energy harvester. In some embodiments, the energy harvesting device may include a solenoid coil generator with one or more corresponding magnets positioned on a component of drill or tool string 10.

As depicted in FIG. 1, processor 105, sensor package 110, memory module 115, communication port 120, and electrical energy source 130 may be housed within pressure barrel 140. In the embodiment depicted in FIG. 1, pressure barrel 140 is cylindrical or generally cylindrical. In other embodiments, pressure barrel 140 may be of other shapes adapted to contain processor 105, sensor package 110, memory module 115, communication port 120, electrical energy source 130, and wireless communications module 122. In some embodiments, the pressure within pressure barrel 140 is atmospheric or near-atmospheric pressure. In some embodiments, the pressure rating for pressure barrel 140 may be at least 15,000 psi.

In some embodiments, the downhole battery life of electrical energy source 130 may be at least 240 hours (or 10 days), and in some embodiments, memory module 115 may have at least 16 M Bytes of storage. In some embodiments, memory module 115 may have up to 8 gigabytes of storage.

As further shown in FIG. 1, end caps 125, 135 may be fitted to the ends of pressure barrel 140. In some embodiments, one or more of pressure barrel 140 or end caps 125, 135 may be formed from a generally electrically, magnetically, and/or electromagnetically transparent material. In some embodiments, for example and without limitation, pressure barrel 140 or end caps 125, 135 may be formed from one or more of a polymer such as polyether ether ketone (PEEK), high-temperature rubber, high-temperature plastic, or high-temperature ceramic material. Depending on the operating conditions to which integrated data recorder 100 will be subjected, a material having high resilience, high mechanical, chemical, and temperature resistance may be used. For example, integrated data recorder 100 used in an oil or gas wellbore may encounter higher temperatures, pressures, and chemical reactivity than integrated data recorder 100 used in a mining operation, and may, accordingly, be built of more resilient materials.

In certain embodiments, communication port 120 may protrude through memory dump end cap 125.

Figure 2A:
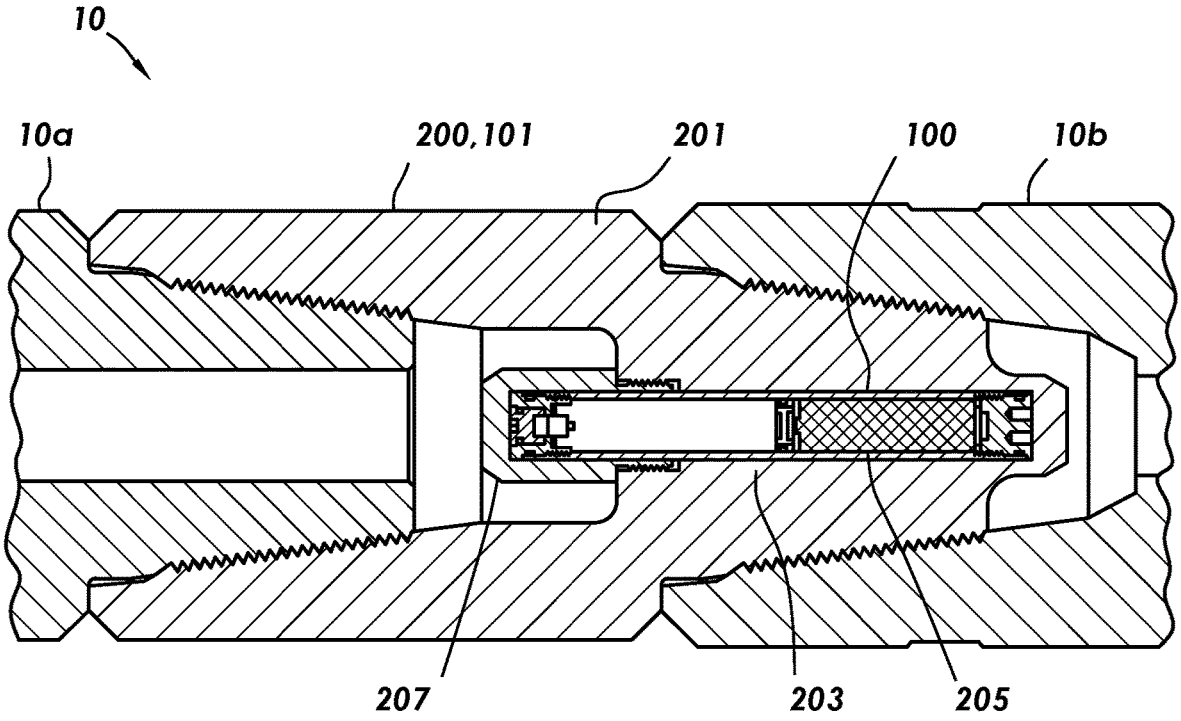
FIG. 2A depicts a cross-section view of a sensor carrier and integrated data recorder consistent with at least one embodiment of the present disclosure.

FIG. 2A depicts integrated data recorder 100 coupled to drill string 10. In some embodiments, integrated data recorder 100 may be coupled to drill string 10 by sensor carrier 101. In some embodiments, sensor carrier 101 may be coupled to drill string 10 such that integrated data recorder 100 is positioned substantially at the center of sensor carrier 101 such that, for example and without limitation, integrated data recorder 100 is positioned substantially along or near the axis of rotation of drill string 10. In some embodiments, integrated data recorder 100 may be positioned substantially aligned with the axis of rotation of drill string 10. In some embodiments, integrated data recorder 100 may be positioned near the axis of rotation of drill string 10 but offset by a small distance. In some such embodiments, integrated data recorder 100 may be, for example and without limitation, within 3 inches of the axis of rotation, within 1 inch of the axis of rotation, or within 0.5 inches of the axis of rotation. As discussed below, integrated data recorder 100 may be used to measure one or more drilling dynamics parameters.

Because integrated data recorder 100 is positioned substantially along or near the axis of rotation of drill string 10, components of integrated data recorder including, for example and without limitation, processor 105, sensor package 110, memory module 115, communication port 120, and electrical energy source 130 as discussed above, may be subjected to less shock and vibration during operation of drill string 10 when compared to an integrated data recorder 100 positioned at the periphery of the component of drill string 10. Additionally, in embodiments in which sensor package 110 includes cross-axial accelerometers, there is less chance of saturating such cross-axial accelerometers when compared to an integrated data recorder 100 positioned at the periphery of the component of drill string 10. Such saturation of a peripherally mounted integrated data recorder 100 may, for example and without limitation, occur repeatedly and rapidly during torsional oscillation or vibration of drill string 10, preventing or reducing the reliability of the measurements taken by such a cross-axial accelerometer. The cross-axial accelerometer data may be used, for example and without limitation, for the calculation of geomechanics parameters, pseudo geo-physical parameters, and/or pseudo formation-evaluation parameters.

In some embodiments, wherein sensor package 110 includes a gyro having sensitive axis substantially aligned with the axis of rotation of drill string 10, angular acceleration may be calculated from the gyro angular velocity by time-differentiating the angular velocity data. The tangential acceleration of the outer surface of the tool within which integrated data recorder 100 is positioned may be calculated by multiplying the derivative of the measured angular velocity (or angular acceleration) by the radius of the tool within which integrated data recorder 100 is positioned. Similarly, the radial acceleration may be calculated by multiplying the squared angular velocity by the radius of the tool within which integrated data recorder 100 is positioned. Alternatively, the angular velocity may be calculated from the accelerometer or magnetometer angular position by time-differentiating the angular position data. Alternatively, the angular acceleration may be calculated from the accelerometer or magnetometer angular velocity by time-differentiating the angular velocity data. In the drilling industry, an accelerometer angular position may be referred to as a gravity toolface (GTF). A magnetometer angular position may be referred to as a magnetic toolface (or MTF).

In some embodiments, sensor carrier 101 may be coupled to or formed as part of any component of a drill or tool string within a wellbore such as, for example and without limitation, a component of a BHA, drill bit, stabilizer, cross-over, drill pipe, drill collar, pin-box connection, jar, reamer, underreamer, friction reducing tool, string stabilizer, near-bit stabilizer, mud motor, turbine, stick-slip mitigation tool, or bearing housing. In some embodiments, sensor carrier 101 may be coupled to or formed as part of any steerable tool, including, for example and without limitation, a steerable motor, a steerable wired-motor, steerable turbine, steerable wired-turbine, steerable gear-reduced turbine, motor-assisted rotary-steerable tool, turbine-assisted rotary-steerable tool, gear-reduced turbine-assisted rotary-steerable tool, MWD (measurement-while-drilling) integrated steerable tool, or coiled tubing steerable tool. In some embodiments, sensor carrier 101 may be coupled to an oil and gas drilling string or may be coupled to or formed as part of a mining/coring tool or mining/coring string including a mining bit. In some embodiments, sensor carrier 101 may be coupled to or formed as part of a component of a drill or tool string located at the surface for drilling, coring and mining or may be coupled to or formed as part of a piece of equipment coupled to the drill string such as, for example and without limitation, a Kelly shaft, saver sub, or component of a top drive such as a quill.

In some embodiments, sensor carrier 101 may be included as part of carrier sub 200 as shown in FIGS. 2A-2D. Carrier sub 200 may, in some embodiments, include threaded connections to allow carrier sub 200 to mechanically couple between tubulars 10*a*, 10*b* of drill string 10. Tubulars 10*a*, 10*b* may be tubular segments of drill string 10, may be components of tools of drill string 10, or may be a combination thereof. In some embodiments, carrier sub 200 may include outer sub body 201 and inner sub body 203. In some such embodiments, integrated data recorder 100 may be positioned within inner sub body 203. In some embodiments, integrated data recorder 100 may be positioned within recess 205 formed within inner sub body 203 and may be retained therein by retention cap 207. Retention cap 207 may be, for example and without limitation, threadedly coupled to inner sub body 203.

Figure 2B:
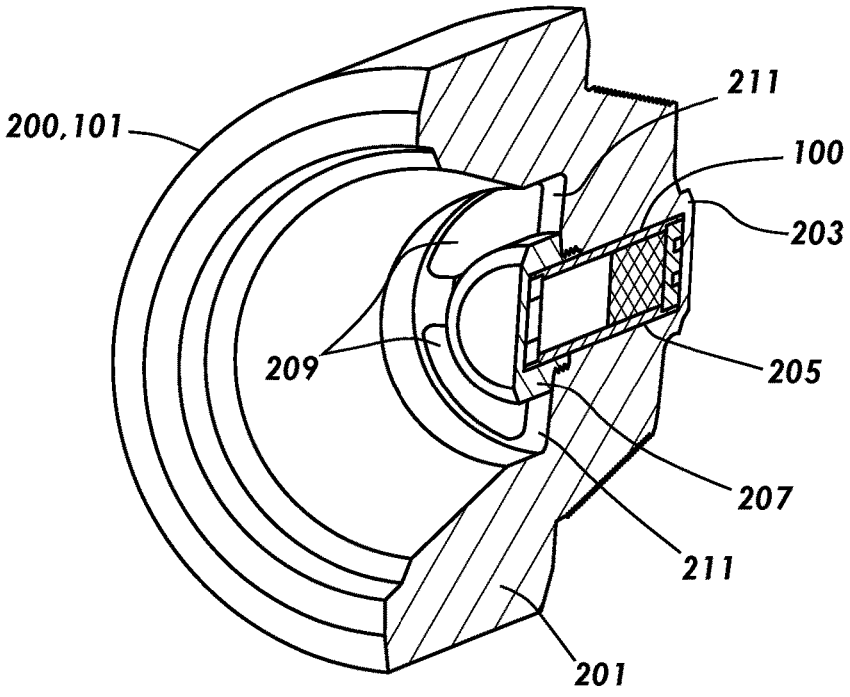
FIGS. 2B, 2C depict perspective cross-section views of the sensor carrier and integrated data recorder of FIG. 2A
Figure 2C:
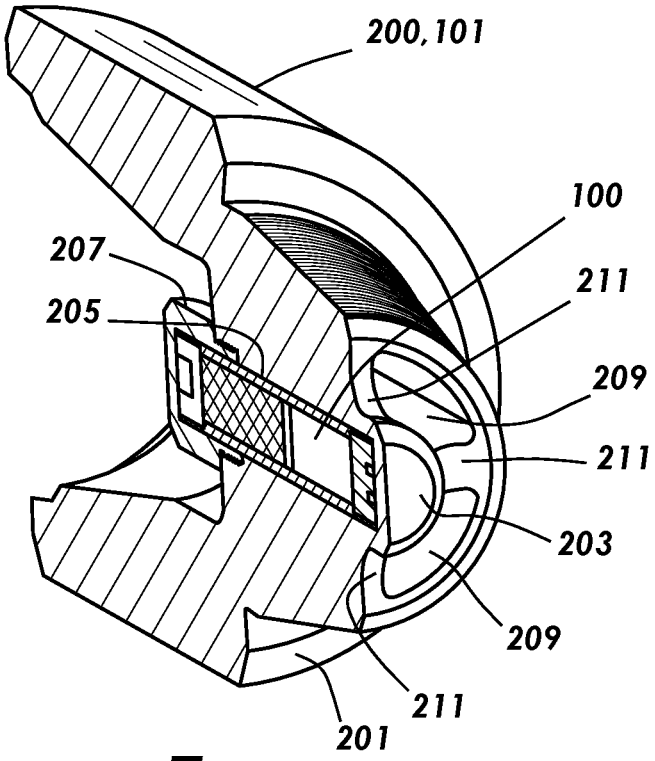
Figure 2D:
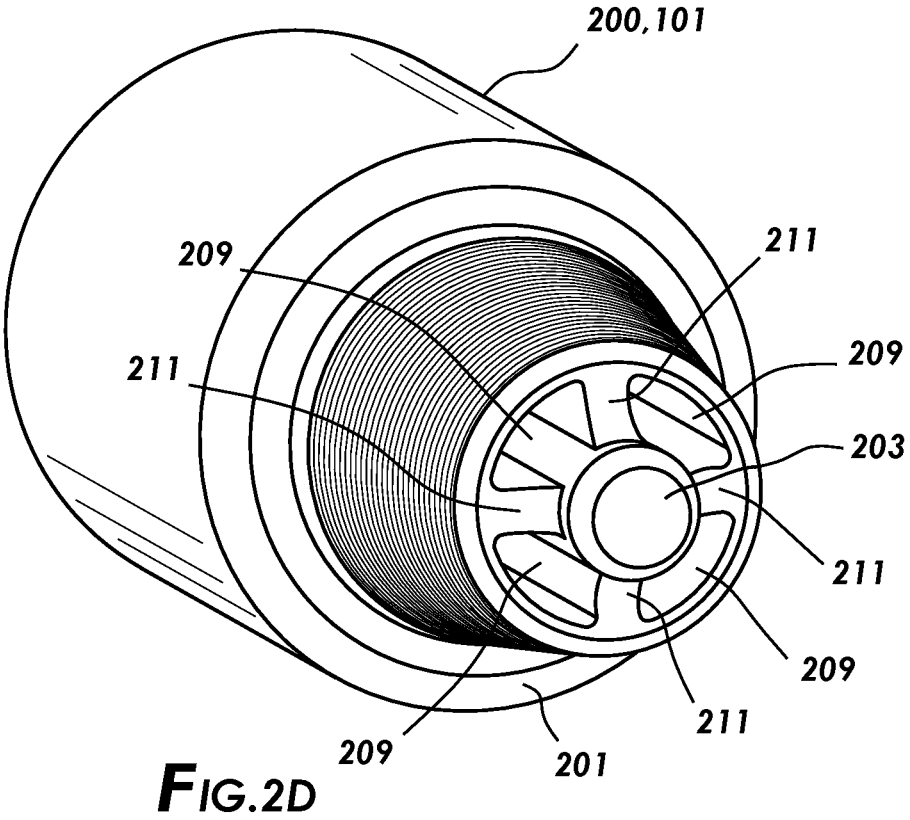
FIG. 2D depicts a perspective view of the sensor carrier and integrated data recorder of FIG. 2A.

In some embodiments, carrier sub 200 may include flowpaths 209, shown in FIGS. 2B-2D, formed between outer sub body 201 and inner sub body 203 to, for example and without limitation, allow for fluid flow from the bore of tubular 10*a* to the bore of tubular 10*b* through carrier sub 200, thereby allowing continuous fluid flow through drill string 10. In some embodiments, carrier sub 200 may include one or more support legs 211 extending between outer sub body 201 and inner sub body 203 to, for example and without limitation, support inner sub body 203 within outer sub body 201. Flowpaths 209 may be defined by the space between outer sub body 201, inner sub body 203, and support legs 211.

Figure 3A:
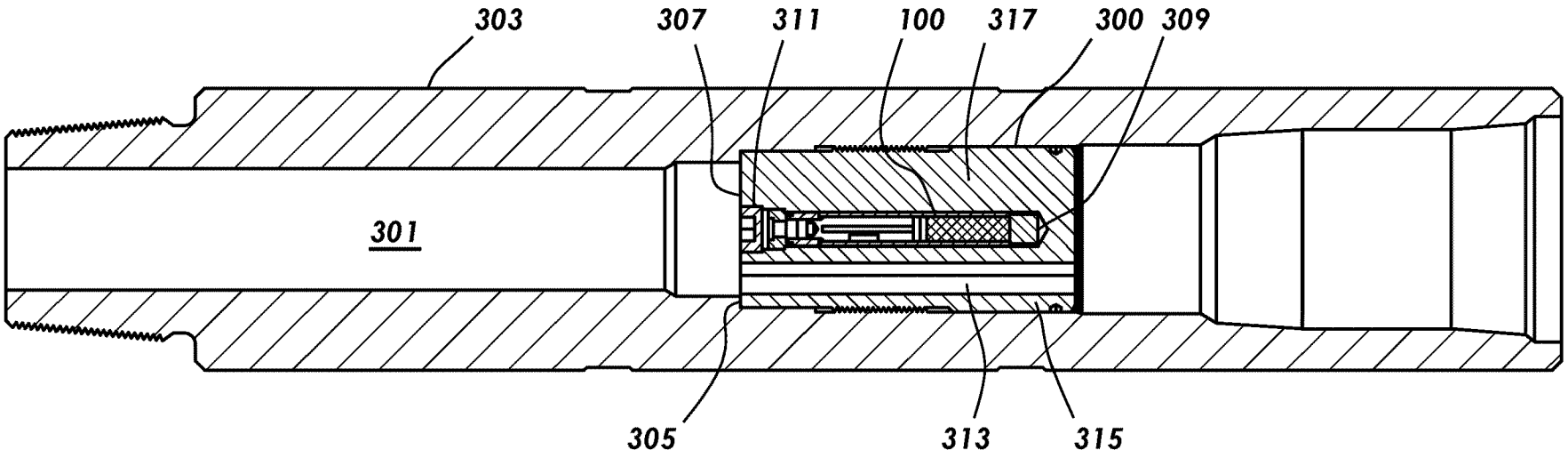
FIG. 3A depicts a cross-section view of a carrier sub and integrated data recorder consistent with at least one embodiment of the present disclosure.
Figure 3B:
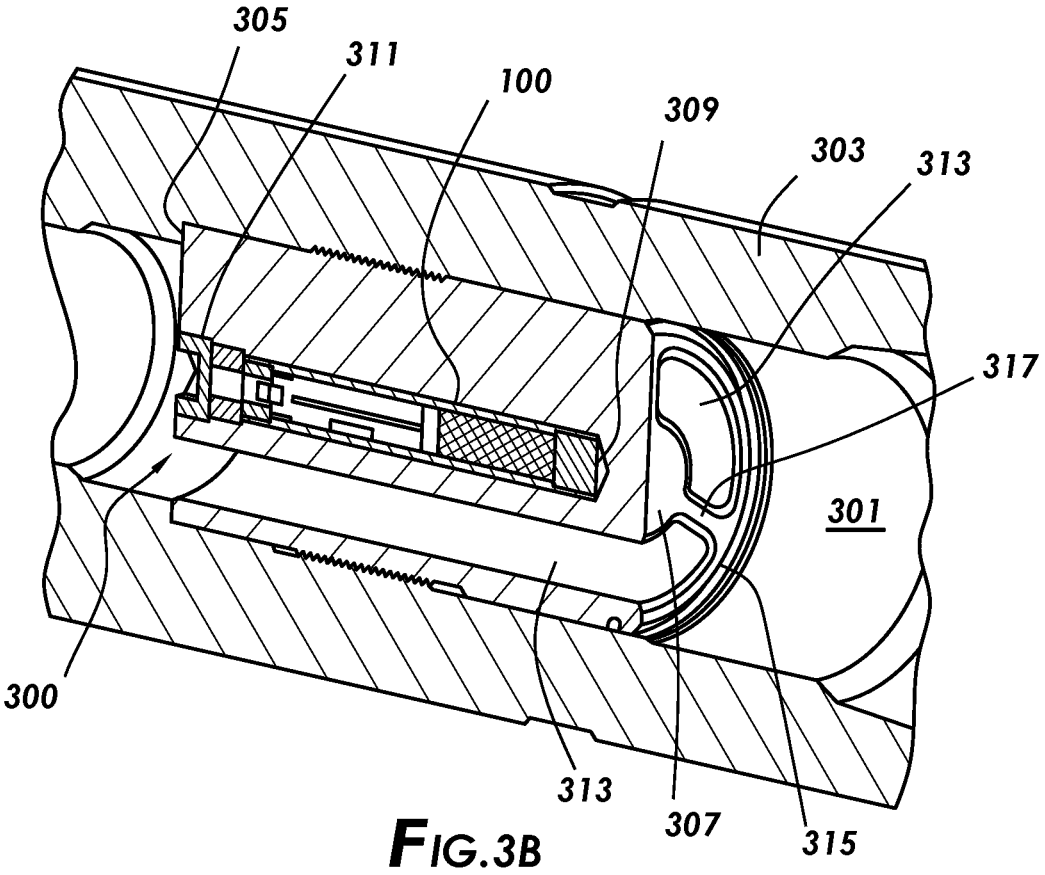
FIG. 3B depicts a perspective cross-section view of the carrier sub and integrated data recorder of FIG. 3A.
Figure 3C:
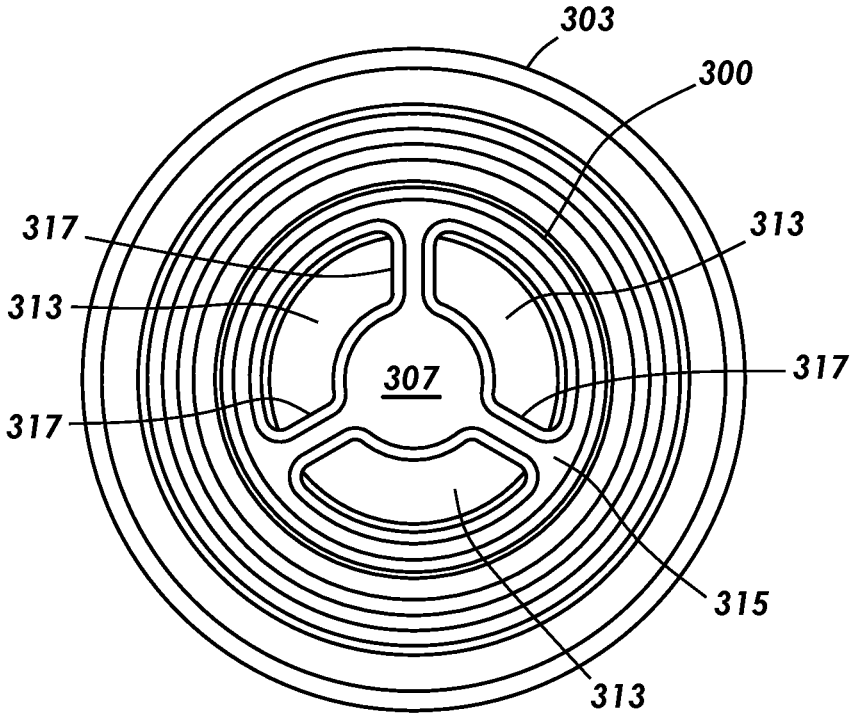
FIG. 3C depicts an end view of the carrier sub and integrated data recorder of FIG. 3A.

In some embodiments, sensor carrier 101 may be included as part of insert sub 300 as depicted in FIGS. 3A-C. Insert sub 300 may be positioned within the bore 301 of tubular 303. Tubular 303 may include one or more retention features 305 such as lips, flanges, or upsets in the wall of bore 301 to allow insert sub 300 to be positioned therein.

In some such embodiments, integrated data recorder 100 may be positioned within inner sub body 307 of insert sub 300. In some embodiments, integrated data recorder 100 may be positioned within recess 309 formed within inner sub body 307 and may be retained therein by retention cap 311. Retention cap 311 may be, for example and without limitation, threadedly coupled to inner sub body 307.

In some embodiments, insert sub 300 may include flowpaths 313 formed between outer sub body 315 and inner sub body 307 to, for example and without limitation, allow for fluid flow through bore 301 of tubular 303 through insert sub 300, thereby allowing continuous fluid flow through tubular 303. In some embodiments, insert sub 300 may include one or more support legs 317 extending between outer sub body 315 and inner sub body 307 to, for example and without limitation, support inner sub body 307 within outer sub body 315. Flowpaths 313 may be defined by the space between outer sub body 315, inner sub body 307, and support legs 317. In some embodiments, outer sub body 315 may mechanically couple to tubular 303.

In some embodiments, insert sub 300 may be positioned within a tubular segment of drill string 10, a tool of drill string 10, or component of a tool of drill string 10. For example and without limitation, in some embodiments, tubular 303, as depicted in FIG. 3A, may be a tubular member such as a drillpipe or other sub coupled between other tubular members of drill string 10. Including insert sub 300 within tubular 303 may, for example and without limitation, allow integrated data recorder 100 to be positioned along drill string 10 at a desired location by including tubular 303 into drill string 10.

Figure 4A:
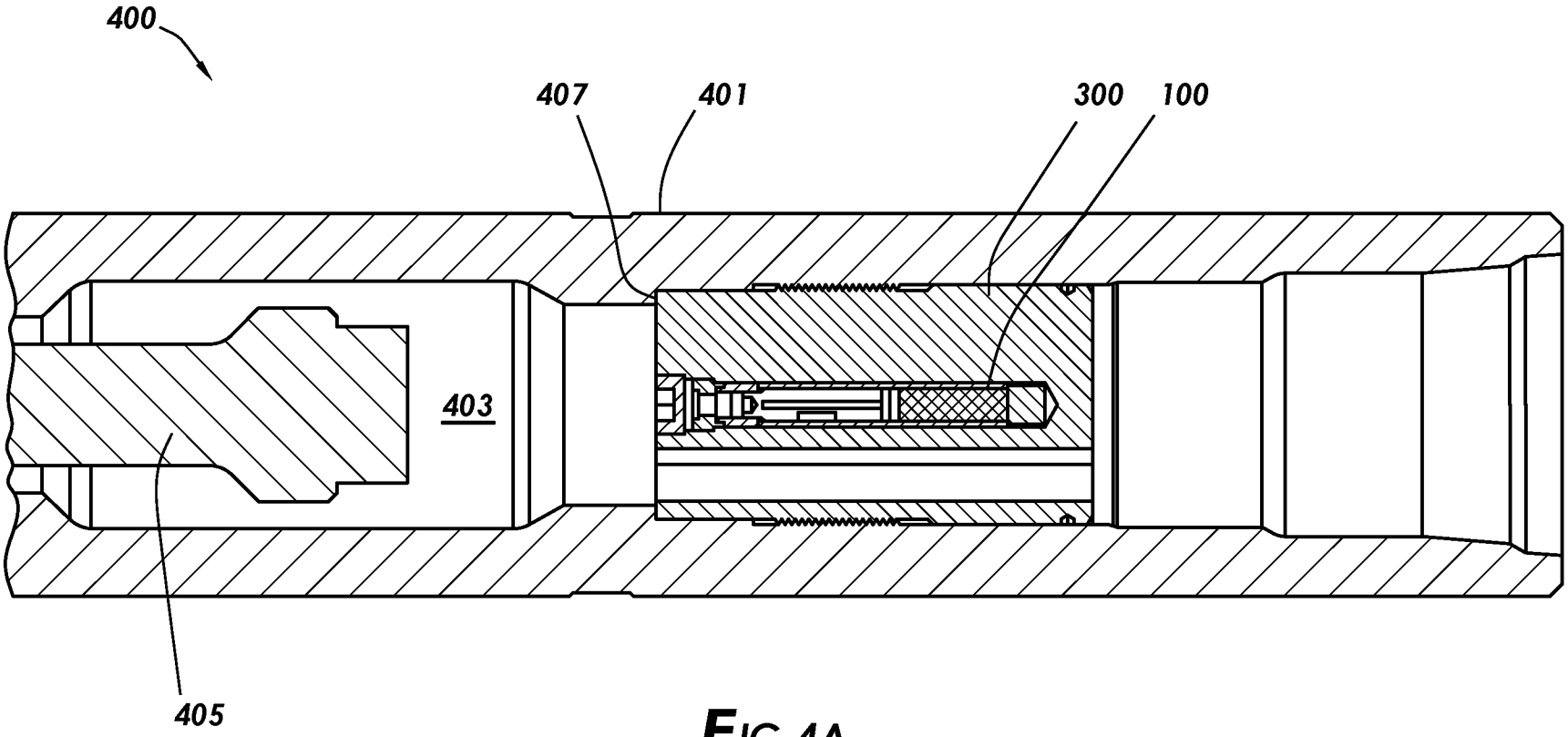
FIGS. 4A, 4B depict cross-section views of a rotor catch including a sensor carrier and integrated data recorder consistent with at least one embodiment of the present disclosure.
Figure 4B:
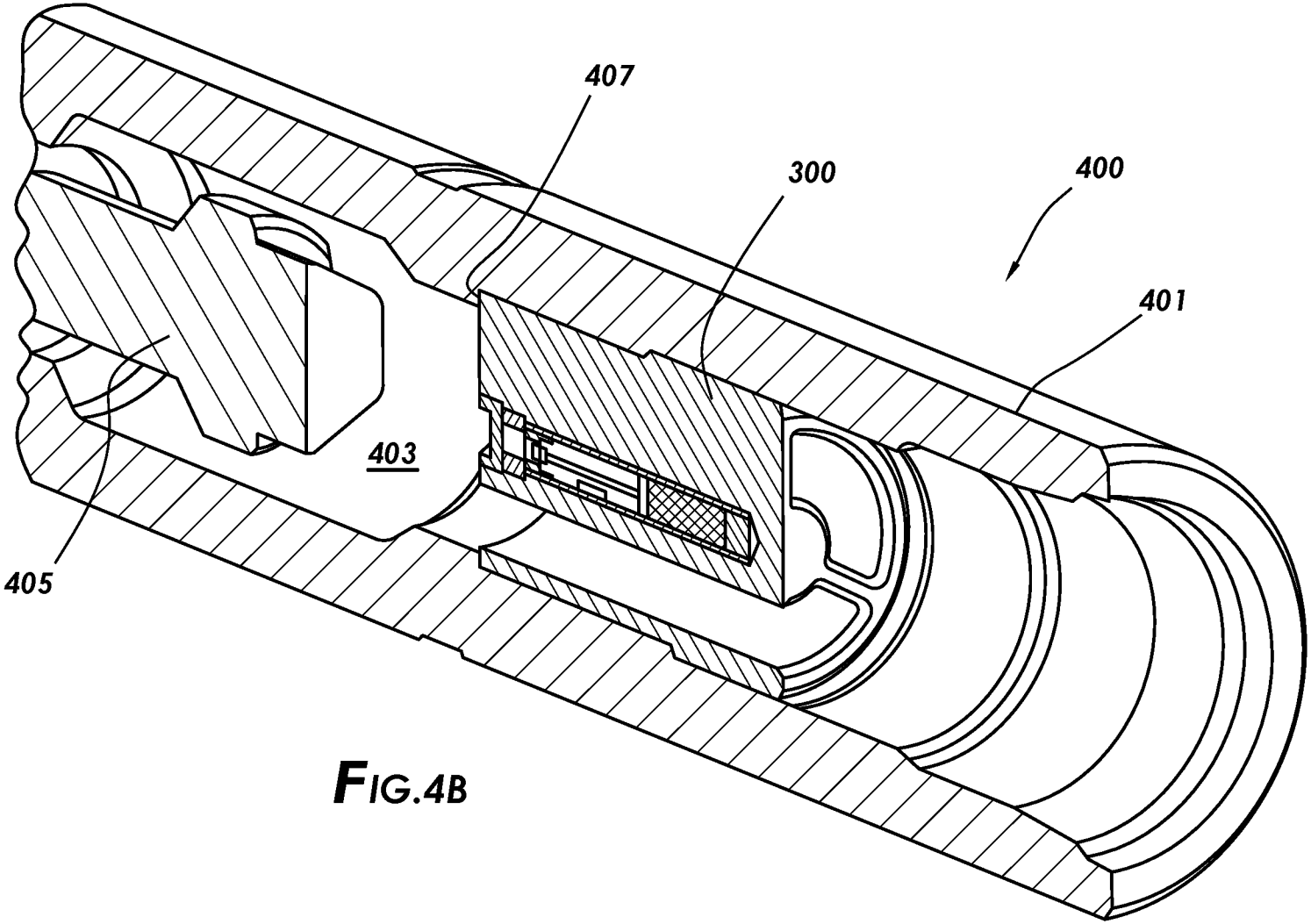

In some embodiments, as depicted in FIGS. 4A, 4B, insert sub 300 may be positioned within rotor catch housing 401 of rotor catch assembly 400. Rotor catch housing 401 may include rotor catch bore 403 and may be used as understood in the art to control or constrain movement of rotor 405 of a downhole motor. Insert sub 300 may be inserted into rotor catch bore 403 and coupled to rotor catch housing 401. In such an embodiment, rotor catch housing 401 may include retention features 407 as discussed above that may allow insert sub 300 to be positioned within rotor catch bore 403. Integrated data recorder 100 may thereby be located at a position within rotor catch assembly 400.

Figure 5:
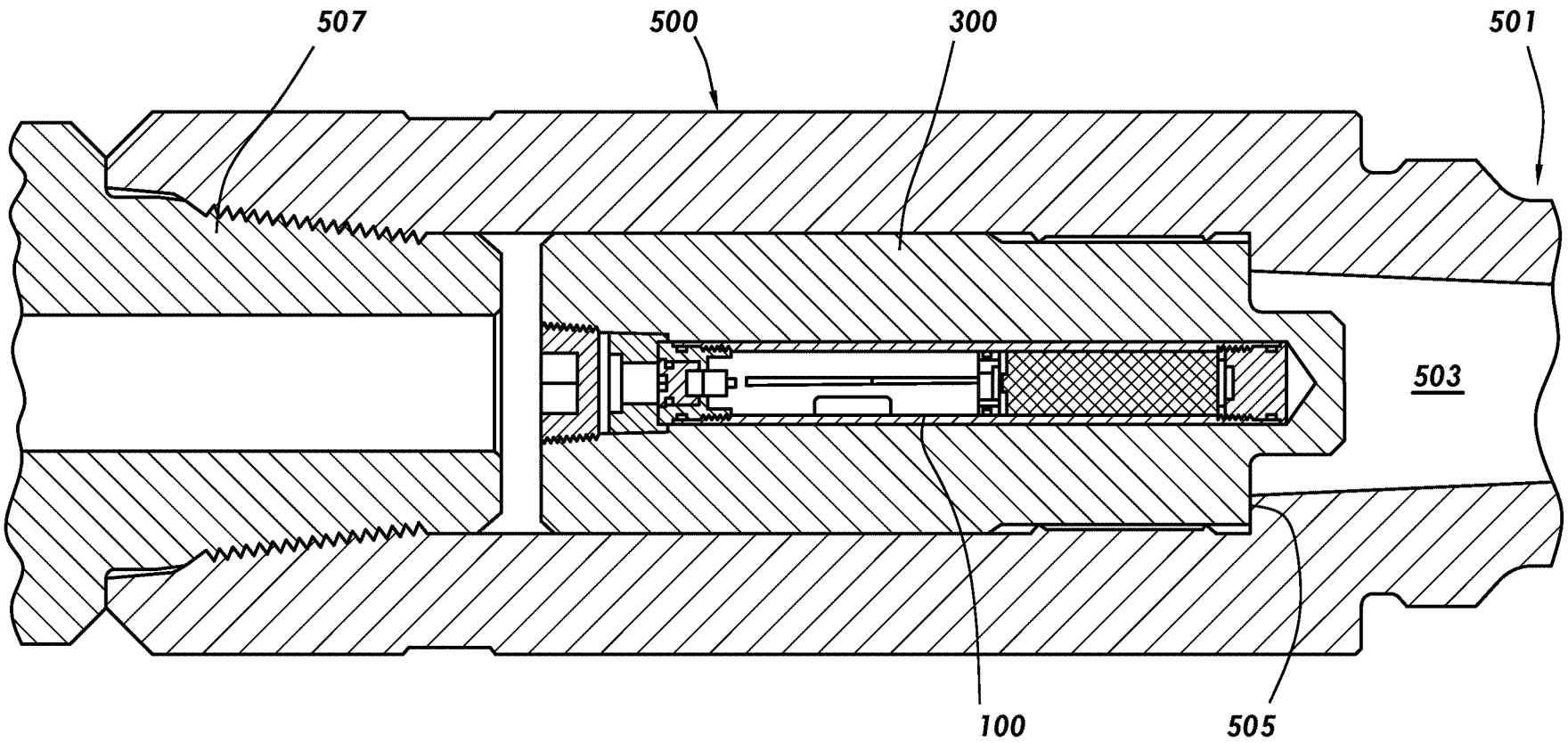
FIG. 5 depicts a bit box including a sensor carrier and integrated data recorder consistent with at least one embodiment of the present disclosure.

In some embodiments, as depicted in FIG. 5, insert sub 300 may be positioned within bit box 500. In some embodiments, bit box 500 may be a part of shaft 501 of a downhole motor or rotary steerable system. Bit box 500 and shaft 501 may include shaft bore 503. Insert sub 300 may be inserted into and coupled to shaft bore 503 of bit box 500 and shaft 501. In such an embodiment, bit box 500 or shaft 501 may include retention features 505 as discussed above that may allow insert sub 300 to be positioned within bit box 500 and shaft 501. Integrated data recorder 100 may thereby be located at a position within bit box 500 or shaft 501 proximate to drill bit 507.

Figure 6A:
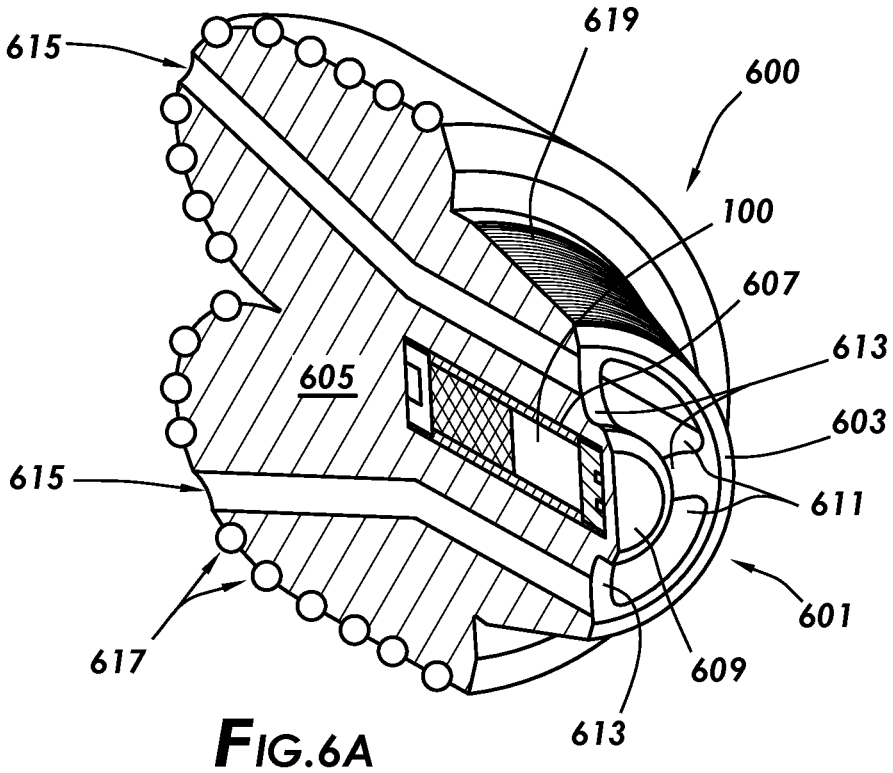
FIG. 6A depicts a perspective cross section view of a drill bit including a sensor carrier and integrated data recorder consistent with at least one embodiment of the present disclosure.
Figure 6B:
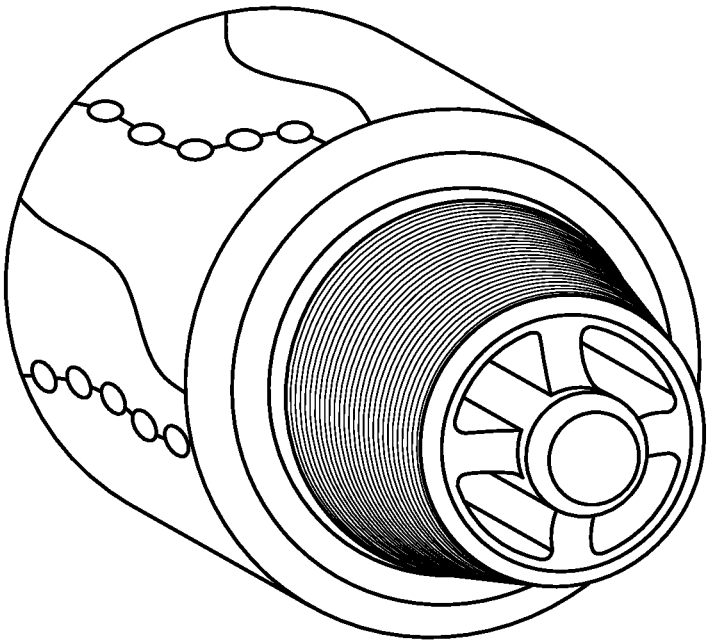
FIG. 6B depicts a perspective view of the drill bit of FIG. 6A.

In some embodiments, sensor carrier 101 may be integrated into a tool of drill string 10. For example, as depicted in FIGS. 6A, 6B, sensor carrier 601 may be formed as part of drill bit 600. Although drill bit 600 is depicted as a fixed cutter (PDC) bit having fixed cutters 617, sensor carrier 101 may be integrated into a roller cone bit, mill tooth bit, diamond drill bit, impregnated diamond drill bit, hybrid bit, or any other type of drill bit without deviating from the scope of the present disclosure. In such an embodiment, sensor carrier 601 may include outer carrier body 603 and inner carrier body 605. Outer carrier body 603 may form a part of drill bit 600 or may be otherwise integrally formed with drill bit 600. In some embodiments, integrated data recorder 100 may be positioned within inner carrier body 605. In some embodiments, integrated data recorder 100 may be positioned within recess 607 formed within inner carrier body 605 and may be retained therein by retention cap 609. Retention cap 609 may be, for example and without limitation, threadedly coupled to inner carrier body 605. Although depicted as being positioned near pin 619 of drill bit 600, in some embodiments, sensor carrier 101 may be located at a position further away from pin 619 without deviating from the scope of this disclosure. For example, sensor carrier 101 may be positioned within a plenum of drill bit 600.

In some embodiments, drill bit 600 may include flowpaths 611 formed between outer carrier body 603 and inner carrier body 605 to, for example and without limitation, allow for fluid flow through nozzles 615 of drill bit 600. In some embodiments, drill bit 600 may include one or more support legs 613 extending between outer carrier body 603 and inner carrier body 605 to, for example and without limitation, support inner carrier body 605 within outer carrier body 603. Flowpaths 611 may be defined by the space between outer carrier body 603, inner carrier body 605, and support legs 613. By positioning integrated data recorder 100 within recess 607 of sensor carrier 601 integrated into drill bit 600, integrated data recorder 100 may thereby be positioned at a location proximate the drilling end of drill string 10. Because integrated data recorder 100 is located near the cutting action of drill bit 600, valuable vibration and shock information may be gathered.

Figure 7:
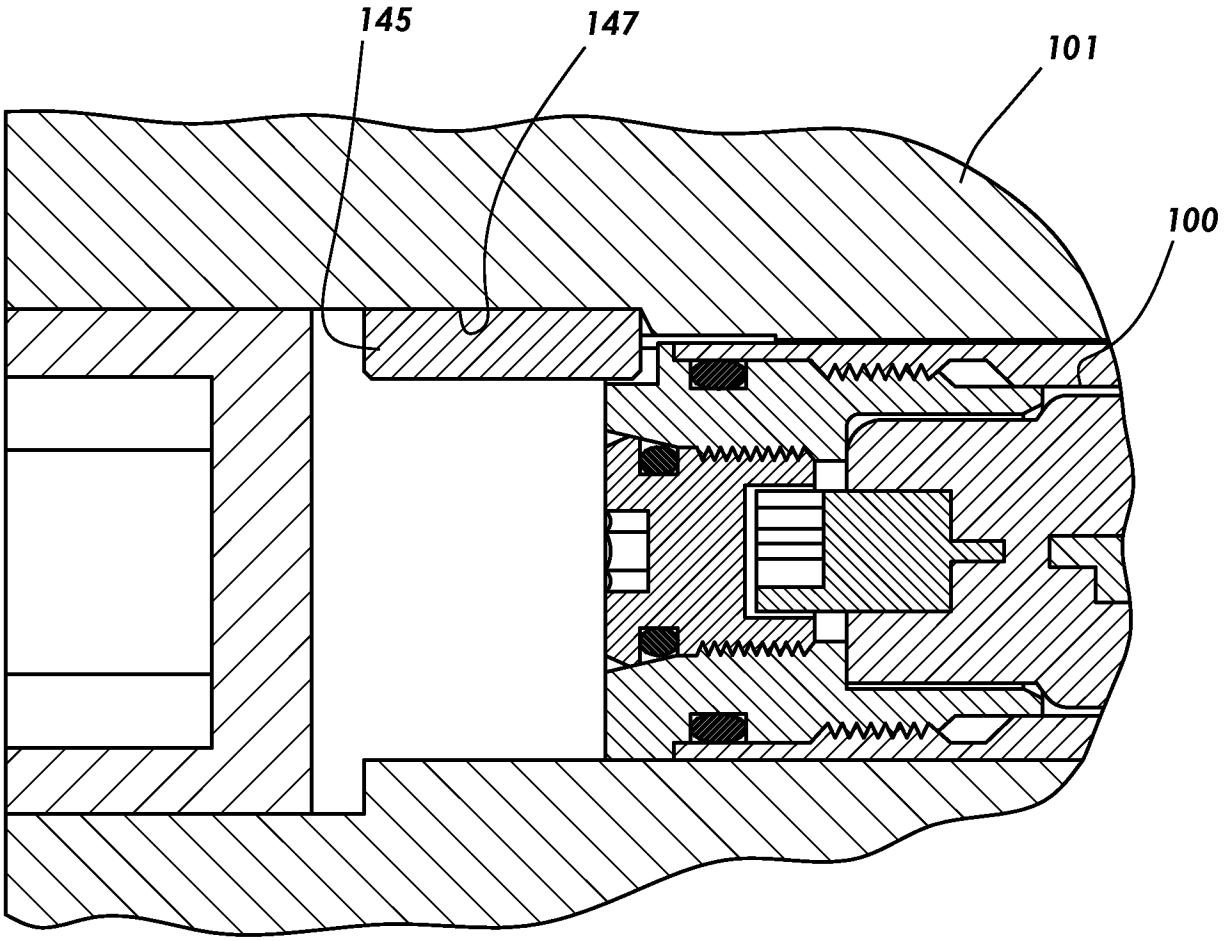
FIG. 7 depicts a detail cross-section view of a sensor carrier and integrated data recorder consistent with at least one embodiment of the present disclosure.

In some embodiments, integrated data recorder 100 may include location pin 145 as depicted in FIG. 7. In some embodiments, location pin 145 may engage with locator slot 147 formed in sensor carrier 101. In some such embodiments, location pin 145 may prevent or reduce rotation of integrated data recorder 100 during operation while integrated data recorder 100 is positioned within sensor carrier 101.

Figure 8:
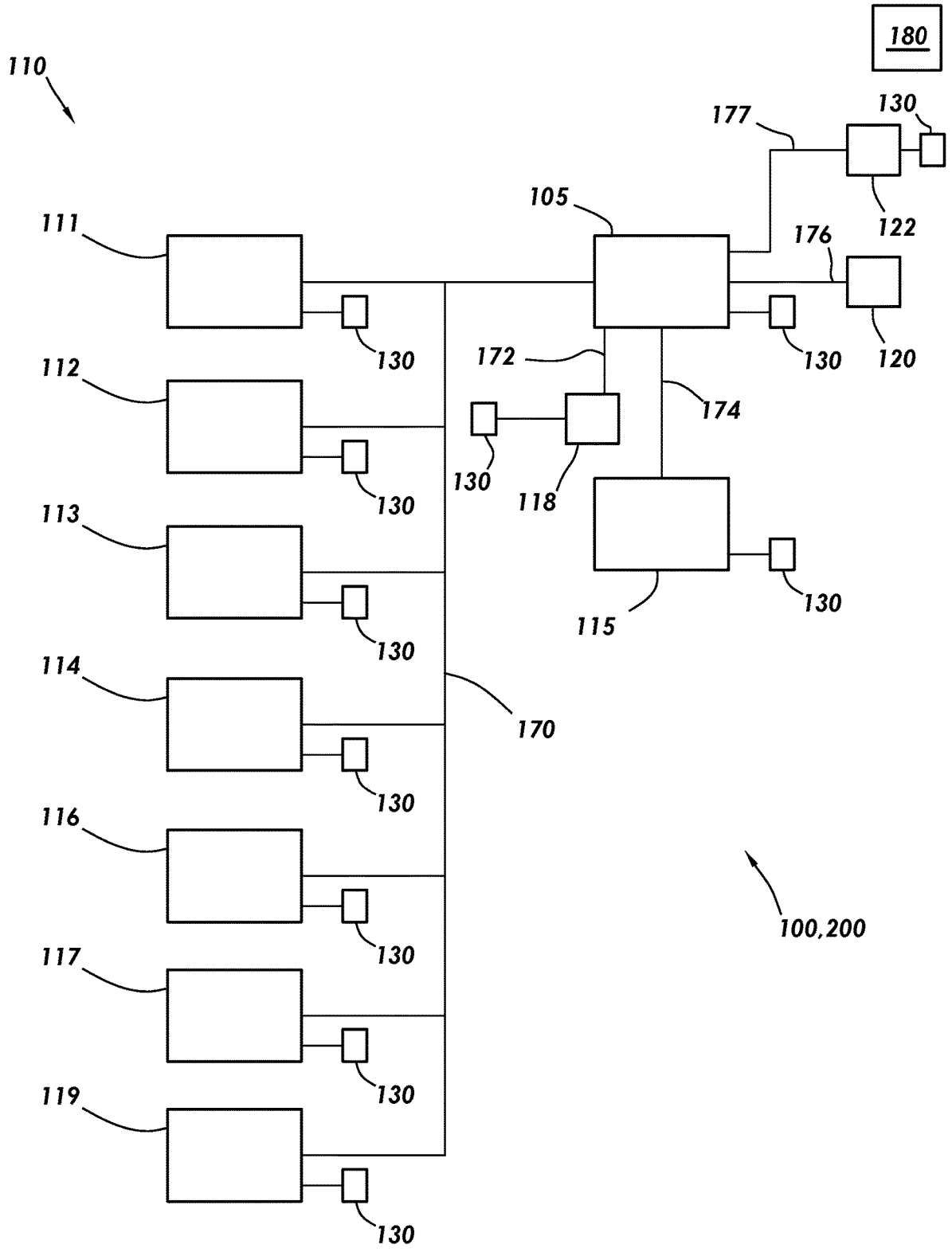
FIG. 8 is a block diagram of an integrated data recorder consistent with at least one embodiment of the present disclosure.

FIG. 8 depicts a block diagram of integrated data recorder 100. Integrated data recorder includes sensor package 110 which includes one or more sensors. In the embodiment shown in FIG. 8, the sensors may include one or more of low-g accelerometer 111, high-g accelerometer 112, gyroscope 113, and temperature sensor 114. In some embodiments, such as the embodiment shown in FIG. 8, the sensors may also include one or more of magnetometer 116, pressure sensor 117, and strain gauge (e.g. weight sensor, bending moment sensor, pressure sensor, etc.) 119. In other embodiments, sensor package 110 may include any of sensors 111, 112, 113, 114, 116, 117, and 119. Sensors 111, 112, 113, 114, 116, 117, and 119 may be in data communication with processor 105 through sensor communication bus 170. Sensor communication bus 170 may be a digital communication bus, such as an SPI (Serial Peripheral Interface) bus or an $I^2C$ (Inter-Integrated Circuit) bus.

In certain embodiments, Hall-effect sensor 118 may be in data communication with processor 105 through Hall-effect sensor bus 172. Hall-effect sensor bus 172 may be a digital communication bus, such as an SPI or an $I^2C$ bus. In some embodiments, Hall-effect sensor 118 is directly connected to processor 105 via an input port, for example, an interrupt pin or an analog-to-digital-converter pin. In other embodiments, Hall-effect sensor 118 may be a digital Hall-effect sensor or analog (ratio-metric) Hall-effect sensor. In other embodiments, Hall-effect sensor 118 may be omitted.

In the embodiment depicted in FIG. 8, memory module 115 is in data communication with processor 105 through memory communication bus 174. Memory communication bus 174 may be a CAN (Controller Area Network) bus, an SPI or an I2C bus in certain non-limiting examples. Thus, sensors 111, 112, 113, 114, 116, 117, and 119 are in data communication with memory module 115 through sensor communication bus 170, processor 105, and memory communication bus 174. Hall-effect sensor 118 is in data communication with memory module 115 through Hall-effect sensor bus 172, processor 105 and memory communication bus 174. Memory module 115 may contain multiple memory devices, such as between 2 and 8 memory devices or 4 memory devices. Each memory device may be a non-volatile memory medium, such as Flash flash or EEPROM (Electrically Erasable Programmable Read-Only Memory) device. One non-limiting example of EEPROM device is a 1-kbit SPI EEPROM, Model 25LC010A from Microchip (Chandler, Arizona, USA).

As further shown in FIG. 8, processor 105 is in data communication with communication port 120 through communication port bus 176. Communication port bus 176 may be a digital communication bus, including, but not limited to, a SCI (Serial Communication Interface) bus, a UART (Universal Asynchronous Receiver/Transmitter) bus, a CAN bus, a SPI bus or a $I^2C$ bus. Communication port 120 may be in data communication with memory module 115 through memory communication bus 174, processor 105, and communication port bus 176. One non-limiting example of processor 105 with such communication bus feature is a 16-bit microcontroller, Model SM470R1B1M-HT from Texas Instruments (Dallas, Texas, USA).

In some embodiments, as further shown in FIG. 8, processor 105 may be in data communication with wireless communications module 122 through wireless communication bus 177. Wireless communication bus 177 may be a digital communication bus, including, but not limited to, a SCI (Serial Communication Interface) bus, a UART (Universal Asynchronous Receiver/Transmitter) bus, a CAN bus, a SPI bus or a I2C bus. Wireless communications module 122 may be in data communication with memory module 115 through memory communication bus 174, processor 105, and wireless communication bus 177. Wireless communications module 122 may, in some embodiments, allow for wireless communication between integrated data recorder 100 and external device 180 as further discussed below. External device 180 may be, for example and without limitation, one or more of a computer, mobile device, personal computer, tablet, smartphone, external data logger, or other suitable system. Wireless communications module 122 may, for example and without limitation, allow for data from memory module 115 to be transmitted to external device 180 without physically interacting with integrated data recorder 100. In some embodiments, external device 180 may upload or stream data from integrated data recorder 100 to a remote location such as, for example and without limitation, a server or cloud network. In some embodiments, integrated data recorder 100 may remain installed to sensor carrier 101 while data is retrieved from memory module 115. In some embodiments, wireless communications module 122 may, for example and without limitation, allow for data/commands from external device 180 to be received by processor 105 without physically interacting with integrated data recorder 100. In some embodiments, the operational setting of integrated data recorder 100 may be changed wirelessly. In some embodiments, external device 180 may be surface equipment with Internet connection or a downhole tool within a drillstring.

Wireless communications module 122 may use any wireless communication protocol for communicating between integrated data recorder 100 and external device 180 including, for example and without limitation, one or more of Wi-Fi, Bluetooth, Bluetooth low energy (BLE), ZigBee, Z-Wave, GSM (Global System for Mobile Communications), CDMA (Code-division multiple access), UMTS (Universal Mobile Telecommunications System), LTE (Long-Term Evolution), GPS (Global Positioning System), satellite communication, or any other wireless communication protocol.

In some embodiments, wireless communications module 122 may be a transceiver such that data or commands transmitted from external device 180 may be received by integrated data recorder 100. In some such embodiments, external device 180 may send instructions to integrated data recorder 100 to, for example and without limitation, configure one or more parameters of sensor package 110 or configure an operational mode of integrated data recorder 100. In some embodiments, for example and without limitation, synchronization or calibration of sensors or other parameters of integrated data recorder 100 may be accomplished using commands transmitted wirelessly from external device 180 to wireless communications module 122.

Figure 9:
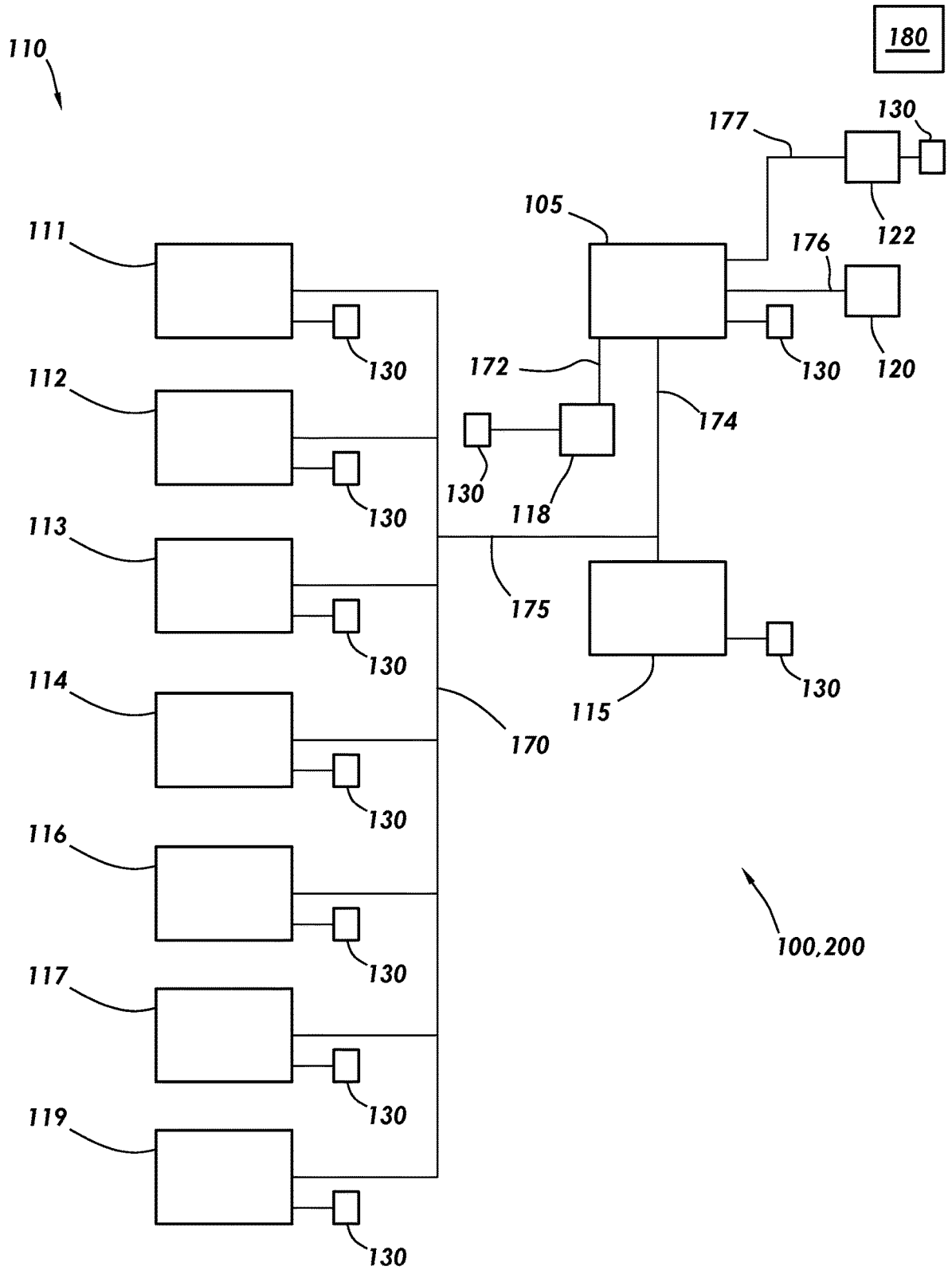
FIG. 9 is a block diagram of an integrated data recorder consistent with at least one embodiment of the present disclosure.

FIG. 9 depicts another embodiment of a block diagram of integrated data recorder 100. In FIG. 9, sensor communication bus 170 and memory communication bus 174 are connected to form sensor-memory bus 175.

In the embodiments shown in FIGS. 8 and 9, electrical energy source 130 is in electrical connection with each of sensors 111, 112, 113, 114, 116, 117, 119, processor 105, memory module 115, and wireless communications module 122. In some embodiments, electrical energy source 130 may be electrically connected to each of sensors 111, 112, 113, 114, 116, 117, 119 directly. In other embodiments, electrical energy source 130 may be electrically connected to each of sensors 111, 112, 113, 114, 116, 117, 119 indirectly through a connection to sensor package 110. In yet other embodiments, electrical energy source 130 may be electrically connected to each of sensors 111, 112, 113, 114, 116, 117, 119 indirectly through a voltage regulator.

In some embodiments, communication port 120 may include a power bus used to provide power to recharge electrical energy source 130. In some embodiments, integrated data recorder 100 may include one or more wireless charging apparatuses to, for example and without limitation, allow electrical energy source 130 to be charged without dismantling integrated data recorder 100.

In some embodiments, multiple integrated data recorders 100 may be included within a single drill string or tool string coupled to various tools at various locations throughout the drill string or tool string. In some embodiments, integrated data recorders 100 may be located within both downhole and surface tools of the drill string or tool string.

In operation, the sensors in sensor package 110 of one or more integrated data recorders 100 within the wellbore may measure drilling dynamics data. The drilling dynamics data may be stored in memory module 115, referred to herein as "memory logging," during the drilling process. When integrated data recorder 100 is retrieved from the wellbore and positioned at the surface, drilling dynamics data may be retrieved from memory module 115 through wireless communications module 122 or by connecting to communication port 120.

In some embodiments, external device 180 at the surface may include a surface processor connected to a cloud data storage and computing server. In some such embodiments, the wirelessly retrieved data may be stored in the cloud data storage and may be processed in the cloud server. For example and without limitation, in some embodiments, a run summary, including rotating hours, flow-on hours, vibration-on hours, shock statistics, stick-slip statistics, or other data gleaned from integrated data recorders 100 may be generated in the cloud server and sent to one or more client devices via the Internet. In some embodiments, both surface recorded drilling dynamics data and downhole recorded drilling dynamics data may be quality-controlled (QC'ed), in the cloud computing system, and combined with data from a surface Electronic Drilling Recorder (EDR). In some embodiments, a drilling dynamics log and accelerometer/gyro spectrograms, such as in JPEG (Joint Photographic Experts Group), PDF (Portable Document Format), may be generated in the cloud computing system. In some embodiments, one or more pattern recognition algorithms (e.g. based on artificial intelligence and machine learning) may be run on the combined data sets to identify, for example and without limitation, operational anomalies and/or data anomalies.

In some embodiments, drilling dynamics data recorded by integrated data recorder 100 may be used for post-run and/or continuous (in the case of surface tools including integrated data recorders 100) evaluation of drilling dynamics, frequency spectrum, statistical analysis, and Condition Based Monitoring/Maintenance (CBM). In some embodiments, frequency spectrum analysis may be done, for example, by applying discrete Fourier transform (or fast Fourier transform) to burst data. In some embodiments, statistical analysis may be done including, for example and without limitation, calculating minimum, maximum, median, mean, mode, root-mean-squared values, standard deviation, and variance of burst data. Statistical analysis may include making histograms of, for example, temperature, vibration, shock, inclination, rotation speed, rotation speed standard deviation, and vibration/shock standard deviation. Temperature histograms may include, for example, accumulating the data points in certain temperature bins over multiple deployments (runs) of the sensors and downhole tools.

CBM is maintenance performed when a need for maintenance arises. This maintenance is performed after one or more indicators show that equipment is likely to fail or when equipment performance deteriorates. CBM may apply systems that incorporate active redundancy and fault reporting. CBM may also be applied to systems that lack redundancy and fault reporting.

CBM may be designed to maintain the correct equipment at the right time. CBM may be based on using real-time data, recorded data, or a combination of real-time and recorded data to prioritize and optimize maintenance resources. Observing the state of a system is known as condition monitoring. Such a system will determine the equipment's health, and act when maintenance is necessary. Ideally, CBM will allow the maintenance personnel to do only the right things, minimizing spare parts cost, system downtime and time spent on maintenance.

Drilling dynamics data, such as high-frequency continuously sampled and recorded data, wherein high-frequency data refers to data at 800 Hz-6400 Hz, may be used for rock mechanics/rock physics analysis. Such rock mechanics analysis include the analysis/identification of fractures, fracture directions, rock confined/unconfined compressive strength, Young's modulus of elasticity, shear modulus, and Poisson's ratio. Such rock mechanics analysis may be accomplished by combining with surface measured parameters, such as WOB (weight on bit), TOB (torque on bit), RPM (revolutions per minute), ROP (rate of penetration), and flow rate. Pseudo formation-evaluation log (or Pseudo rock-physics log), such as pseudo-sonic log, pseudo-neutron log, pseudo-porosity log, pseudo-density log, pseudo-Gamma log may be generated with a combination of the analysis of high-frequency continuously sampled and recorded data, along with surface parameters, and other formation-evaluation data, such as natural Gamma log and other logging-while-drilling (LWD) logs. Alternatively, high-frequency continuously-sampled data (e.g. at 800 Hz-6400 Hz) may be used for real-time rock mechanics analysis. Rock mechanical parameters may also be referred to as geomechanical parameters. Alternatively, pseudo-formation evaluation log, such as pseudo-Gamma log may be generated downhole and transmitted to the surface for real-time geo-steering.

Power from electrical energy source 130 may be supplied to the sensors in sensor package 110. In some embodiments, the electrical power from electrical energy source 130 to the sensors in sensor package 110 is always on (powered up) but at different levels. At the lowest power level, which in some embodiments may be used while integrated data recorder 100 are being transported, integrated data recorder 100 may be in "deep-sleep mode." In deep sleep mode, the real-time clock, sensors, for example, sensors 111, 112, 113, 114, 116, 117 and 119, memory module 115, and voltage regulator are powered off and processor 105 is placed in sleep mode. In certain embodiments, current consumption of this deep-sleep mode may be between 1 uA and 200 uA. In sleep mode, processor 105 does not function, except to receive a "wake-up" signal. The wake-up signal may, in some embodiments, be received through wireless communications module 122. In some embodiments, integrated data recorder 100 may be placed in deep sleep mode by a software command to processor 105 received through wireless communications module 122. Integrated data recorder 100 may be transitioned from deep-sleep mode to standby mode by communicating the wake-up signal to processor 105 through wireless communications module 122 while processor 105 is in passive mode. In some embodiments, processor 105 may be woken up by one or more active mode predetermined event criteria including, for example and without limitation, an inclination trigger, RPM trigger, temperature trigger, vibration trigger, or pressure trigger, in which a certain inclination of sensor carrier 101, rotation rate of sensor carrier 101, temperature measurement, vibration of sensor carrier 101, or pressure measurement, respectively, measured by one or more corresponding sensors of sensor package 110 of integrated data recorder 100 causes processor 105 to enter the standby or operational state.

Deep-sleep mode may, for example and without limitation, extend battery life during transportation and/or storage without requiring physical disassembly of integrated data recorder 100. Physical disassembly of integrated data recorder 100 may damage seals, threads, wires, and other elements if done by an unfamiliar technician in a remote location. The recorder may be in "deep-sleep mode" for as much as between 1 month and 1 year before it is sent downhole for dynamics data logging.

In standby mode, processor 105 and at least one sensor (active sensor) of sensor package 110 are active. Digital solid-state sensors may be put into standby mode using a digital command. Standby current to remaining sensors of sensor package 110 may be around 1 μA to 200 uA. Once an active mode predetermined event criterion is met, as determined, for example, by the active sensor, processor 105 sends a command to the remaining sensors of sensor package 110 to begin measurement of data and to memory module 115 to begin logging data ("active mode").

The active mode predetermined event criterion may be, for example, a temperature, pressure, acceleration, acceleration standard deviation, rotation speed standard deviation, or inclination threshold as determined by the active sensor. The active mode predetermined event may also be a drill string or bit rotation rate threshold. In some embodiments, the active mode predetermined event criterion may be a combination of one or more of a temperature threshold, pressure threshold, acceleration threshold, acceleration standard deviation threshold, rotation speed standard deviation threshold, inclination threshold, drill string rotation rate threshold, or bit rotation rate threshold. In some embodiments, the active mode threshold that predetermines event criterion may be stored in digital, solid-state sensors, which may generate interrupt events to processor 105. For example, one non-limiting example of a digital, solid-state sensor with such feature is an $I^2C$ digital temperature sensor, Model MCP9800 from Microchip (Chandler, Arizona, USA). Temperature thresholds with hysteresis (e.g. upper threshold and lower threshold) may be stored in MCP9800. In certain embodiments, all sensors are non-active during standby mode and the drill string or bit rotation (using accelerometers, gyros, magnetometers or a combination thereof) may be communicated to and received by integrated data recorder 100 via downlink communication from the surface. In certain embodiments, downlink communication may be accomplished by mud-pulse telemetry, electro-magnetic (EM) telemetry, wired-drill-pipe telemetry or a combination thereof. In other embodiments, downlink communication may be accomplished by varying the drill string rotation rate, for example and not limited to the method described in US Patent Publication No. 2017/0254190, entitled System and Method for Downlink Communication, published Sep. 7, 2017.

In certain embodiments, during active mode, once a predetermined passive mode criterion has been met, processor 105 may send a command to the sensors of sensor package 110 and memory module 115 to return to standby mode, thereby discontinuing measurement of data by the sensors and logging of data by memory module 115. The passive mode predetermined event criterion may be, for example, a temperature threshold, pressure threshold, acceleration threshold, acceleration standard deviation threshold, RPM threshold, or inclination threshold as determined by one or more sensors of sensor package 110. In some embodiments, the passive mode thresholds that predetermine event criterion may be stored in digital, solid-state sensors, which may generate interrupt events to processor 105. One non-limiting example of digital, solid-state sensor with such feature is an $I^2C$ digital temperature sensor, Model MCP9800 from Microchip (Chandler, Arizona, USA). Temperature thresholds with hysteresis (e.g. upper threshold and lower threshold) may be stored in MCP9800. In one non-limiting example, the digital, solid state sensor made may change from the passive mode (no logging) to the active mode (logging) and from the active mode (logging) to the passive mode (no logging) multiple times, based on one or more, or a combination of event thresholds.

In active mode, sensors in sensor package 110 are turned on for a predetermined duration at a predetermined log interval for measurement of drilling dynamics data. Examples of predetermined duration include 1-10 seconds. Examples of predetermined log intervals are every 1, 2, 5, 10, 20, 30, or 60 seconds and durations between those values. Predetermined log intervals for each of the sensors in sensor package 110 may be the same or different. Predetermined durations for each of the sensors in sensor package 110 may be the same or different.

In certain embodiments, the sensors of sensor package 110 record burst data to memory module 115 at a burst data frequency. In some embodiments, the burst data frequency may, for example and without limitation, be 20 Hz or more, 50 Hz or more, 100 Hz or more, 200 Hz or more, 400 Hz or more, 800 Hz or more, 1600 Hz or more, 3200 Hz or more, or 6400 Hz or more. Examples of burst data log interval include every 1, 2, 5, 10, 20, 30, or 60 seconds. The sensor burst data may be buffered in digital sensors in the built-in sensor memory, which may be configured as FIFO (first-in first-out) memory. In certain embodiments, processor 105 does not store sensor burst data in processor's RAM (random access memory), i.e., sensor data is sent directly from the sensors in sensor package 110 to memory module 115. In certain embodiments, processor 105 may store a predetermined number of samples of sensor burst data (for example, just one sample of sensor burst data) in the RAM of processor 105 prior to sending the sensor burst data to memory module 115. In other embodiments, high-frequency sampling data, for example, at 6400 Hz, is continuously stored to memory module 115, such as continuously bursting and recording.

The use of the FIFO memory of a sensor may reduce processor 105 processing capability requirements and processor 105 power consumption. In certain embodiments, the number of the FIFO memories of a sensor may be between 32 and 1025 data points, or between 32 and 512 data points per sensor axis. One FIFO memory may hold, for example, 16 bits or 32 bits, depending on the sensor output resolution. For example, a 3-axis sensor may contain up to 16-bit×100-points×3-axis=48000 bits of FIFO memory. In some embodiments, the sensors of sensor package 110 may record statistics of some or each of the sensors. For example, the statistics of the high-g 3-axis accelerometer data, such as minimum, maximum, mean, median, root-mean-squared, standard deviation, and variance values may be recorded by the sensor package and, in certain embodiments, transmitted to memory module 115. In some embodiments, sensor package 110 may record burst data of the low-g 3-axis digital accelerometer data 3-axis magnetometers and 3-axis digital gyroscope. In other embodiments, sensor package 110 may record continuously sampled data, for example, at 3200 Hz, of the 3-axis digital accelerometer data and 3-axis digital gyroscope. Raw analog-to-digital counts for accelerometers and gyroscopes, i.e., a number representing voltage, may be recorded in memory module 115 without temperature calibration or conversion to final units. In certain embodiments, temperature calibration may be performed by processor 105 for drilling dynamics data measured by the sensors of sensor package 110. Temperature calibration may correct for the scale drift factor and offset drift over temperature. In certain embodiments, temperature calibration may be accomplished, for example, by look-up tables.

In some embodiments, ranges of some or all of the sensors in sensor package 110 may be changed while integrated data recorder 100 is within the wellbore. For example, the low-G accelerometer sensing range is programmable and changeable downhole from +/−4 G to +/−16 G and all ranges therebetween. For example, the high-G accelerometer sensing range may be programmable and changeable downhole from +/−100 G to +/−400 G and all ranges therebetween. Ranges may be changed based on attainment of a predetermined range threshold value or by communication by downlink from the surface. Examples of predetermined range thresholds include, but are not limited to values of rotation speed standard deviation, acceleration standard deviation, or combinations thereof.

In certain embodiments, sampling frequency of some or all of the sensors in sensor package 110 may be changed while integrated data recorder 100 is within the wellbore. Sample frequency may be changed based on attainment of a predetermined sampling threshold value or by communication by downlink from the surface. Examples of predetermined sampling thresholds include, but are not limited to, values of rotation speed standard deviation, acceleration standard deviation, or combinations thereof.

In some embodiments, some or all of the sensors in sensor package 110 may include an anti-aliasing filter on one or all of the axes of the sensor. The frequency of the anti-aliasing filter may be changed while integrated data recorder 100 is within the wellbore. For example, the anti-aliasing filter may be changed to between 25 Hz and 6400 Hz for accelerometers. In some embodiments, the anti-aliasing filter frequency may be changed when sampling frequency is changed to avoid aliasing.

In some embodiments, integrated data recorder 100 may communicate with an MWD tool through communications port 120 or through wireless communications module 122. In one non-limiting example, statistics of downhole dynamics data (for example, maximum shock, RPM standard deviation, root-mean-squared shock, mean vibration, median inclination, etc.) may be transmitted to surface via an MWD mud-pulse telemetry, electro-magnetic (EM) telemetry, EM short-hop telemetry, wired-drill-pipe telemetry or a combination thereof. In some embodiments, the sensor data may be transmitted to the MWD tool wirelessly. For example, an at-bit integrated data recorder 100 may transfer the sensor data from the bit to an MWD tool with a wireless module, via integrated data recorders 100 placed at multiple locations in a bottom-hole assembly (BHA). A wireless network, such as, for example and without limitation, Z-wave, may allow the data transferred from one device to another via other wireless modules using Z-wave's source-routed mesh network architecture. In some embodiments, the MWD tool may relay the drilling dynamics data to surface via a communications channel including, for example and without limitation, mud-pulse telemetry, electro-magnetic (EM) telemetry, EM short-hop telemetry, wired-drill-pipe telemetry or a combination thereof. In some embodiments, wireless integrated data recorders placed at many different positions in a drill string may relay at-bit sensor information from a bit to surface, such as, for example, for real-time geo-steering applications.

In some embodiments, integrated data recorder 100 may be used with an inductive coupler described in U.S. Pat. No. 10,119,343 "Inductive coupling". In some such embodiments, inner annular segment as described therein may be mechanically coupled to outer annular segment by three radial spokes. The radial spokes may define flow paths through which fluid may pass between the integrated data recorder and collar through the sub.

In some embodiments, integrated data recorder 100 may be positioned in an existing tool. In some embodiments, integrated data recorder 100 may be added to the downhole tool without altering the tool length or mechanical integrity of the tool. In some such embodiments, a slot as described herein above may be formed in one or more components of the existing tool, and one or more integrated data recorders 100 may be placed therein.

In some embodiments, integrated data recorder 100 may be utilized during transportation of sensor carrier 101. In such an embodiment, integrated data recorder 100 may measure one or more aspects of the movement of sensor carrier 101 including, for example and without limitation, the location of sensor carrier 101 and one or more parameters relating to the handling of sensor carrier 101 including detection of drops, shock loads, or other mishandling of sensor carrier 101.

In some embodiments, information about the operation of bottom-hole assembly (BHA) may be transmitted to the surface via mud pulse telemetry. In some embodiments, temperature difference, temperature gradient, and other drilling dynamics information may be classified into different severity levels, for example, 4 to 8 severity levels indicative of a measured condition. As a non-limiting example, in embodiments in which 2-bit severity levels (4 levels) are used, a temperature difference may be coded as Level 1 which may be between 0 and 2 degrees centigrade, Level 2 between 2 and 4 degrees centigrade, Level 3 between 4 and 6 degrees centigrade, and Level 4 above 6 degrees centigrade. Similarly, downhole acceleration events or shocks may be coded as Level 1 (no shock) between 0 and 10 g, Level 2 (low) between 10 and 40 g, Level 3 (medium) between 40 and 100 g, and Level 4 (high) above 100 g. As another example, high-frequency torsional oscillation (HFTO) may be detected with tangential acceleration measurement or angular gyro measurement with an expected frequency range, for example, between 100 and 1600 Hz. Angular acceleration can be calculated by time-differentiating the angular gyro velocity. By applying a digital band-pass, digital band-reject, analog band-pass, analog band-reject, high-pass filter, digital high-pass filter, analog high-pass filter, or a combination thereof on a tangential accelerometer or gyro, downhole HFTO events may be coded as Level 1 (no HFTO) between 0 and 10 g, Level 2 (low HFTO) between 10 and 40 g, Level 3 (medium HFTO) between 40 and 100 g, and Level 4 (high HFTO) above 100 g. Alternatively, at integrated data recorder, filtered accelerations (for example, tangential accelerations, lateral accelerations, radial accelerations, angular accelerations, axial accelerations, etc.) may be used to estimate pseudo-formation-evaluation parameters, such as pseudo-sonic log, pseudo-neutron log, pseudo-porosity log, pseudo-density log, and pseudo-Gamma log. Pseudo formation-evaluation parameters and/or their severity levels may be transmitted to surface for geo-steering.

Rock mechanics parameters (e.g. Young's modulus, shear modulus, Poisson's ratio, compressive strength, and Fractures) may be detected with tri-axial high-frequency acceleration measurement with an expected frequency range, for example, between 100 and 1000 Hz, as described, for example in SPWLA 2017—"A Novel Technique for Measuring (Not Calculating) Young's Modulus, shear modulus, Poisson's Ratio and Fractures Downhole: A Bakken Case Study". By applying a digital band-pass, digital band-reject, analog band-pass, analog band-reject, digital high-pass filters, analog high-pass filters, or a combination thereof on the at least one accelerometer or gyro, downhole fractures may be coded as Level 1 (no fractures) between 0 and 10, Level 2 (low) between 10 and 40, Level 3 (medium) between 40 and 100, and Level 4 (high) above 100 (the numbers are without units, but correlated to the number of fractures). Rock mechanics parameters and/or their severity levels may be transmitted to surface for geo-steering.

In some embodiments, more than one sensor may be used on the centerline in all tools mentioned herein. For example, in some embodiments, two or more integrated data recorders 100 may be included within a single tool.

Figure 10:
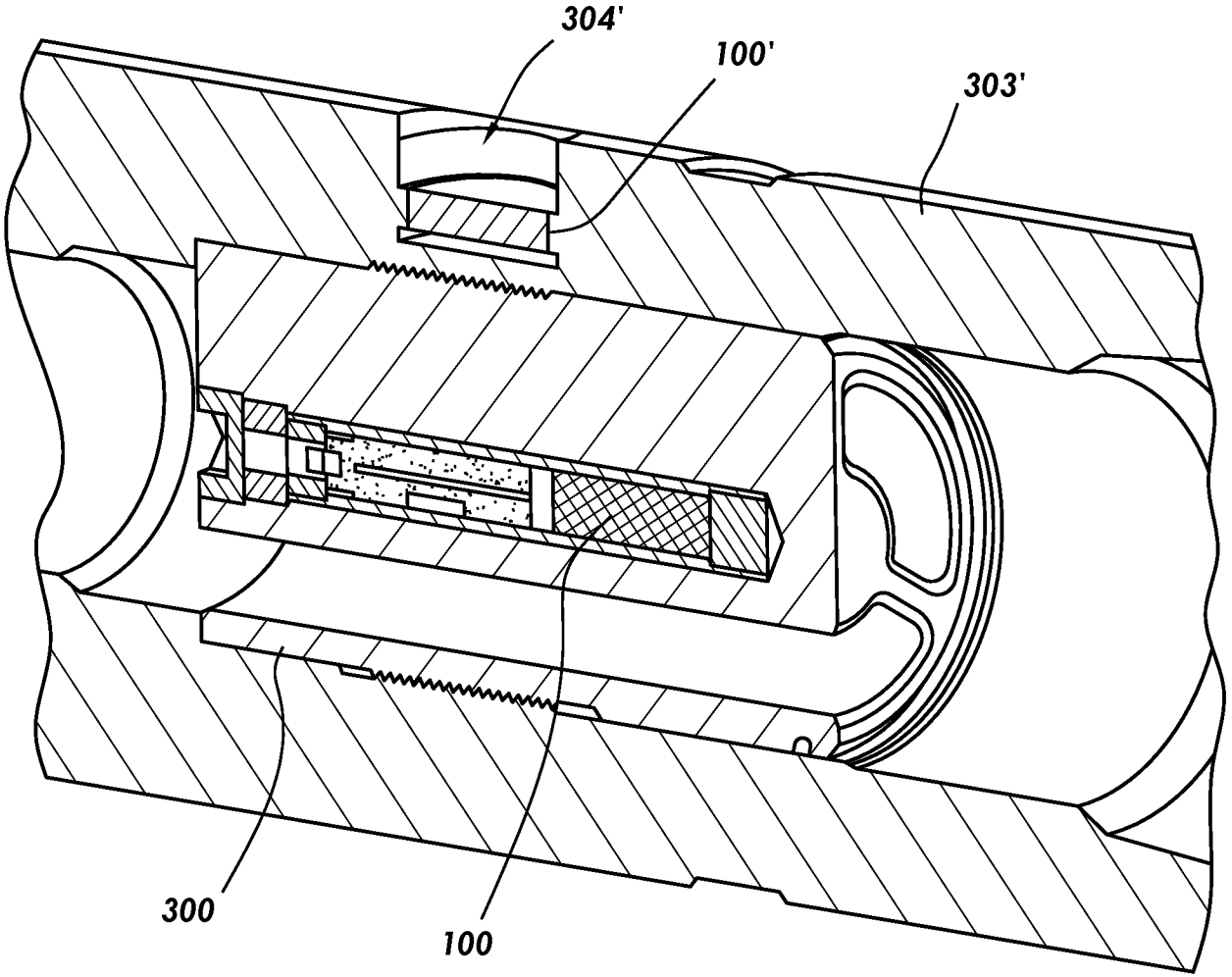
FIG. 10 depicts a cross-section view of a carrier sub and integrated data recorder consistent with at least one embodiment of the present disclosure.

In some embodiments, as depicted in FIG. 10, the tool into which insert sub 300 is located may include one or more additional sensors. For example and without limitation, in some embodiments, tubular 303' may include sensor pocket 304' adapted to receive an additional integrated data recorder 100'. Additional integrated data recorder 100' may, in some embodiments, operate in conjunction with integrated data recorder 100 positioned at or near the axis of rotation of tubular 303' to, for example and without limitation, improve the accuracy of drilling dynamics measurement.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

providing a sensor carrier, the sensor carrier including:

an outer sub body;

an inner sub body, the inner sub body coupled to the outer sub body by a support leg, the inner sub body having a recess formed therein; and a flow path defined as a space between the outer sub body, the inner sub body, and the support leg;

providing an integrated centerline data recorder within the recess of the inner sub body such that the integrated centerline data recorder is substantially at a centerline of the sensor carrier, the integrated centerline data recorder positioned within a downhole tool, the integrated centerline data recorder including:

a sensor package, the sensor package comprising one or more drilling dynamics sensors, at least one of the one or more drilling dynamics sensors being a gyroscope;

a processor, the processor in data communication with the one or more drilling dynamics sensors;

a memory module, the memory module in data communication with the one or more drilling dynamics sensors; and an electrical energy source, the electrical energy source in electrical communication with the memory module, the one or more drilling dynamics sensors, and the processor; and taking measurements using the gyroscope, the measurements comprising angular acceleration by time-differentiating angular velocity data forming angular acceleration data.

2. The method of claim 1 wherein the angular acceleration data is recorded downhole or transmitted to a surface location.

3. The method of claim 1 further comprising calculating tangential acceleration by multiplying a derivative of a measured angular velocity or the angular acceleration by a radius of the downhole tool.

4. The method of claim 1 further comprising calculating radial acceleration by multiplying a squared angular velocity by a radius of the downhole tool.

5. The method of claim 1 further comprising calculating the angular velocity data from accelerometer or magnetometer angular position by time-differentiating angular position data.

6. The method of claim 1, wherein the sensor carrier is formed as a part of a drill bit.

7. A method comprising:

providing a sensor carrier, the sensor carrier including:

an outer sub body;

an inner sub body, the inner sub body coupled to the outer sub body by a support leg, the inner sub body having a recess formed therein; and a flow path defined as a space between the outer sub body, the inner sub body, and the support leg;

providing an integrated centerline data recorder within the recess of the inner sub body such that the integrated centerline data recorder is substantially at a centerline of the sensor carrier, the integrated centerline data recorder positioned within a downhole tool, the integrated centerline data recorder including:

a sensor package, the sensor package comprising one or more drilling dynamics sensors, at least one of the one or more drilling dynamics sensors being a gyroscope;

a processor, the processor in data communication with the one or more drilling dynamics sensors;

a memory module, the memory module in data communication with the one or more drilling dynamics sensors; and an electrical energy source, the electrical energy source in electrical communication with the memory module, the one or more drilling dynamics sensors, and the processor; and taking measurements using the one or more drilling dynamics sensors, the measurements comprising high frequency torsional oscillation (HFTO) magnitude and/or severity.

8. The method of claim 7, wherein the HFTO magnitude and/or severity is measured by time-differentiating angular velocity data measured with the gyroscope.

9. The method of claim 7 further comprising detecting the HFTO magnitude with an angular gyroscope measurement with an expected frequency range, wherein the expected frequency range is between 50 Hz and 1600 Hz.

10. The method of claim 9 further comprising applying a digital band-pass filter, a digital band-reject filter, an analog band-pass filter, an analog band-reject filter, a high-pass filter, a digital high-pass filter, an analog high-pass filter, or a combination thereof on the gyroscope.

11. The method of claim 10 further comprising coding the HFTO as Level 1 (no HFTO) between 0 g and 10 g, Level 2 (low HFTO) between 10 g and 40 g, Level 3 (medium HFTO) between 40 g and 100 g, and Level 4 (high HFTO) above 100 g based on the application of the digital band-pass filter, the digital band-reject filter, the analog band-pass filter, the analog band-reject filter, the high-pass filter, the digital high-pass filter, the analog high-pass filter, or the combination thereof on the gyroscope.

12. A method comprising:

providing a sensor carrier, the sensor carrier including:
- an outer sub body;
- an inner sub body, the inner sub body coupled to the outer sub body by a support leg, the inner sub body having a recess formed therein; and
- a flow path defined as a space between the outer sub body, the inner sub body, and the support leg;

providing an integrated centerline data recorder within the recess of the inner sub body such that the integrated centerline data recorder is substantially at a centerline of the sensor carrier, the integrated centerline data recorder positioned within a tool, the tool being a steering tool of a bottomhole assembly, the integrated centerline data recorder including:

a sensor package, the sensor package comprising one or more drilling dynamics sensors, at least one of the one or more drilling dynamics sensors being a gyroscope;

a processor, the processor in data communication with the one or more drilling dynamics sensors;

a memory module, the memory module in data communication with the one or more drilling dynamics sensors; and an electrical energy source, the electrical energy source in electrical communication with the memory module, the one or more drilling dynamics sensors, and the processor;

taking measurements using the one or more drilling dynamics sensors, the measurements comprising pseudo-formation-evaluation parameters;

transmitting the measurements from the one or more drilling dynamics sensors to a surface location; and using the measurements from the one or more drilling dynamics sensors for real-time geosteering.

13. The method of claim 12, wherein a pseudo-formation-evaluation parameter comprises a pseudo-Gamma log.

14. The method of claim 12, wherein a pseudo-formation-evaluation parameter is generated from a combination of analysis of high-frequency continuously sampled and recorded data from the one or more drilling dynamics sensors.

15. The method of claim 14, wherein the pseudo-formation-evaluation parameter generation also includes surface parameters.

16. The method of claim 15, wherein the pseudo-formation-evaluation parameter generation also includes a natural Gamma log.

17. A method comprising:

providing a sensor carrier, the sensor carrier including:
- an outer sub body;
- an inner sub body, the inner sub body coupled to the outer sub body by a support leg, the inner sub body having a recess formed therein; and
- a flow path defined as a space between the outer sub body, the inner sub body, and the support leg;

providing an integrated centerline data recorder within the recess of the inner sub body such that the integrated centerline data recorder is substantially at a centerline of the sensor carrier, the integrated centerline data recorder positioned within a tool, the tool being a steering tool of a bottomhole assembly, the integrated centerline data recorder including:

a sensor package, the sensor package comprising one or more drilling dynamics sensors, at least one of the one or more drilling dynamics sensors being a gyroscope;

a processor, the processor in data communication with the one or more drilling dynamics sensors;

a memory module, the memory module in data communication with the one or more drilling dynamics sensors; and an electrical energy source, the electrical energy source in electrical communication with the memory module, the one or more drilling dynamics sensors, and the processor;

taking measurements using the one or more drilling dynamics sensors, the measurements comprising high-frequency continuously sampled and recorded data, wherein the high-frequency continuously sampled and recorded data refers to data at 800 Hz-6400 Hz; and generating filtered measurements by applying a digital band-pass filter, a digital band-reject filter, an analog band-pass filter, an analog band-reject filter, a high-pass filter, a digital high-pass filter, an analog high-pass filter, or a combination thereof to the measurements.

18. The method of claim 17 further comprising using the filtered measurements for rock mechanics/rock physics analysis.

19. The method of claim 18, wherein the rock mechanics/rock physics analysis includes analysis/identification of fractures, fracture directions, rock confined/unconfined compressive strength, Young's modulus of elasticity, shear modulus, or Poisson's ratio.

20. The method of claim 19, wherein rock mechanics analysis includes surface parameters.

* * * * *